US009961942B2

(12) United States Patent
Liu

(10) Patent No.: US 9,961,942 B2
(45) Date of Patent: May 8, 2018

(54) ELECTRONIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 0 days. days.

(21) Appl. No.: 15/445,908

(22) Filed: Feb. 28, 2017

(65) Prior Publication Data

US 2017/0354182 A1 Dec. 14, 2017

(30) Foreign Application Priority Data

Jun. 8, 2016 (CN) ..... 2016 2 0549082 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 131/329
See application file for complete search history.

(56) References Cited

U.S. PATENT DOCUMENTS

| | | | | |
|---|---|---|---|---|
| 9,661,878 | B2 * | 5/2017 | Liu | A24F 47/008 |
| 9,788,577 | B2 * | 10/2017 | Liu | H05B 3/0014 |
| 9,801,418 | B1 * | 10/2017 | Liu | A24F 7/00 |
| 2016/0000145 | A1 * | 1/2016 | Liu | A24F 47/008 131/329 |

* cited by examiner

*Primary Examiner* — Tulsidas C Patel
*Assistant Examiner* — Travis Chambers
(74) *Attorney, Agent, or Firm* — Matthias Scholl P.C.; Matthias Scholl

(57) ABSTRACT

An electronic cigarette, including an air regulation ring assembly, an atomizing core assembly, and a base assembly. The air regulation ring assembly includes a mouthpiece having a fixing base and a rubber silicon ring, a first sealing ring, an air regulation ring having a fixing base, a second sealing ring. The atomizing core assembly includes a liquid barrier, a third sealing ring, a limit cover, a fourth sealing ring, a first piece of cotton, a second piece of cotton, a pair of heating wires, a fixing ring of the heating wires, a first insulating ring, and a heating wire connector. The base assembly includes a glass tube, a fifth sealing ring, a copper thread ring, a second insulating ring, and a connector.

1 Claim, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims the benefit of Chinese Patent Application No. 201620549082.X filed Jun. 8, 2016, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to an electronic cigarette.

Description of the Related Art

An electronic cigarette or e-cigarette is a handheld electronic device that vaporizes an e-liquid. The e-liquid is loaded in the glass tube of the electronic cigarette and must flow from the base assembly to an atomizing core of the electronic device to be vaporized. However, the connection of the glass tube and the atomizing core is untight, which means the e-liquid tends to leak out.

SUMMARY OF THE INVENTION

In view of the above-described problems, it is one objective of the invention to provide an improved electronic cigarette from which the e-liquid therein does not leak out.

To achieve the above objective, in accordance with one embodiment of the invention, there is provided an electronic cigarette, comprising an air regulation ring assembly, an atomizing core assembly, and a base assembly. The air regulation ring assembly comprises a mouthpiece comprising a fixing base, a first sealing ring. The fixing base of the mouthpiece is provided with a slot, and the first sealing ring is disposed on the slot, so that the mouthpiece is properly disposed in the fixing base of the mouthpiece, and resistance exists when the mouthpiece is pulled out. A fixing base of air regulation ring comprises an upper slot and a lower slot, and a second sealing ring is secured to the upper slot on the fixing base of air regulation ring. An air regulation ring is fixedly connected to the fixing base of the air regulation ring. Two sides of the air regulation ring each are provided with a hole. Air is input from one hole, and is output from the other hole. The air fixing base is rotated to regulate the air flow. The second sealing ring provides resistance when the fixing base is rotated, thus ensuring a proper rotation of the fixing base. A rubber silicon ring is disposed in the lower slot on the fixing base. The rubber silicon ring is integrated with a glass tube and a fifth sealing ring of the base assembly to seal the e-liquid.

Preferably, the atomizing core assembly comprises a pair of heating wires. The heating wires are nickel-chromium material, and are sheathed in a second piece of cotton. The heating wires are installed vertically in a fixing ring. The heating wires comprise two feet. One foot is connected to a heating wire connector, and the other foot is connected to an inner wall of the fixing ring. When the heating wires are electrified, the second piece of cotton is adapted to absorb and store the e-liquid, and smoke is naturally produced. A first insulating ring is hollow, and is mounted in a lower part of the fixing ring. The heating wire connector is inserted in a central hole of the first insulating ring. The heating wire connector is used as a positive electrode and is connected to an anodic foot of the heating wires, and a cathodic foot is connected to the fixing ring. The first insulating ring is adapted to isolate the positive electrode from the negative electrode, thus avoiding any short circuit. A first piece of cotton is sleeved on the fixing ring. A fourth sealing ring is mounted on a limit cover, and the limit cover is sleeved on the first piece of cotton. The limit cover is fixedly connected to the fixing ring. Two sides of the limit cover each are provided with an e-liquid inlet hole, and the e-liquid is allowed to enter from the e-liquid inlet hole of the limit cover, and passes through the first piece of cotton and the second piece of cotton to the heating wires which is electrified to produce large amount of smoke. The third sealing ring is mounted on the limit cover, and a liquid barrier is disposed on an upper part of the limit cover. the liquid barrier is fixedly connected to the limit cover. One side of the liquid barrier is provided with an air inlet hole, and the other side of the liquid barrier is provided with an air outlet hole. Air is allowed to enter from the air inlet hole, pass through the heating wires and the air outlet hole, and be discharged from the mouthpiece of the air regulation assembly.

Preferably, the base assembly comprises a copper thread ring, a second insulating ring, and a connector. The second insulating ring comprises a central hole. The second insulating ring is mounted on a lower part of the copper thread ring. The connector is adapted to conduct electricity for the positive electrode, and the connector is mounted on the lower part of the copper thread ring. The connector is connected to the heating wire connector of the atomizing core assembly. The second insulating ring is adapted to isolate the positive electrode from the negative electrode, thus avoiding short circuit. An upper part of the copper thread ring is provided with a slot, and a fifth sealing ring is secured to the slot on the upper part of the copper thread ring. The glass tube is disposed on the copper thread ring, and the fifth sealing ring is disposed lower than the glass tube. The glass tube is adapted to store the e-liquid. The air regulation assembly comprises the rubber silicon ring, and the rubber silicon ring is disposed higher than the glass tube. The rubber silicon ring is adapted to seal the e-liquid.

Advantages of the electronic cigarette according to embodiments of the invention are summarized as follows:

The air is input from the top of the electronic cigarette, and the air flow through which is also adjusted from the top. The heating wires are nickel-chromium material, and are vertically disposed. The air flow is input from a hole on the air regulation ring, passes through the heating wire on the left and the heating wire on the right, and is output from the mouthpiece, thus the air flow input and the air flow regulation are realized on the top of the electronic cigarette, effectively preventing the leakage of e-liquid. By twisting up the fixing base of the air regulation ring, and the e-liquid can be added in the cigarette.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing an electronic cigarette are described below. It should be noted that the following examples are intended to describe and not to limit the invention.

Figure 1:
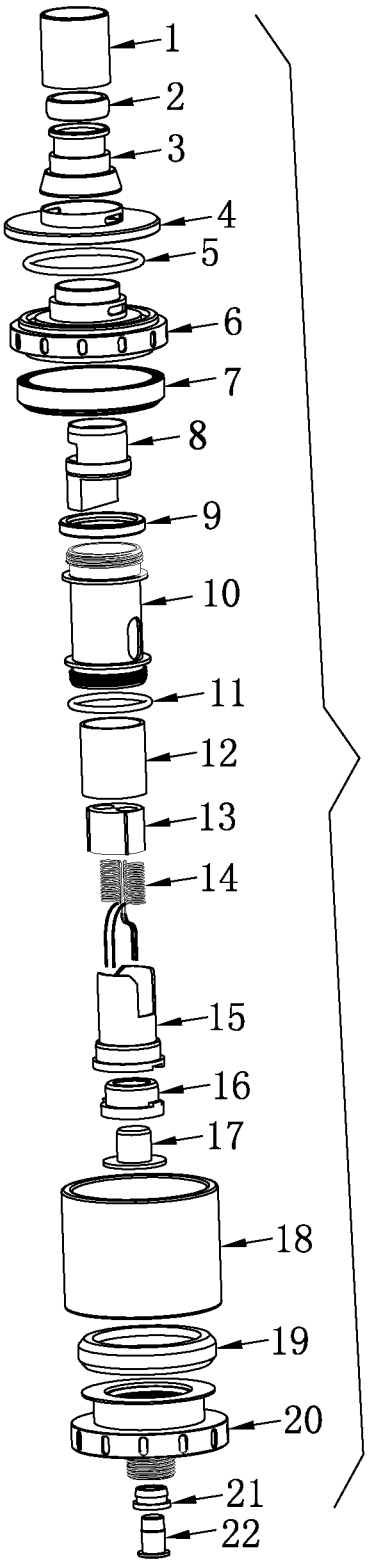
FIG. 1 is an exploded view of an electronic cigarette in accordance with one embodiment of the invention.
Figure 2:
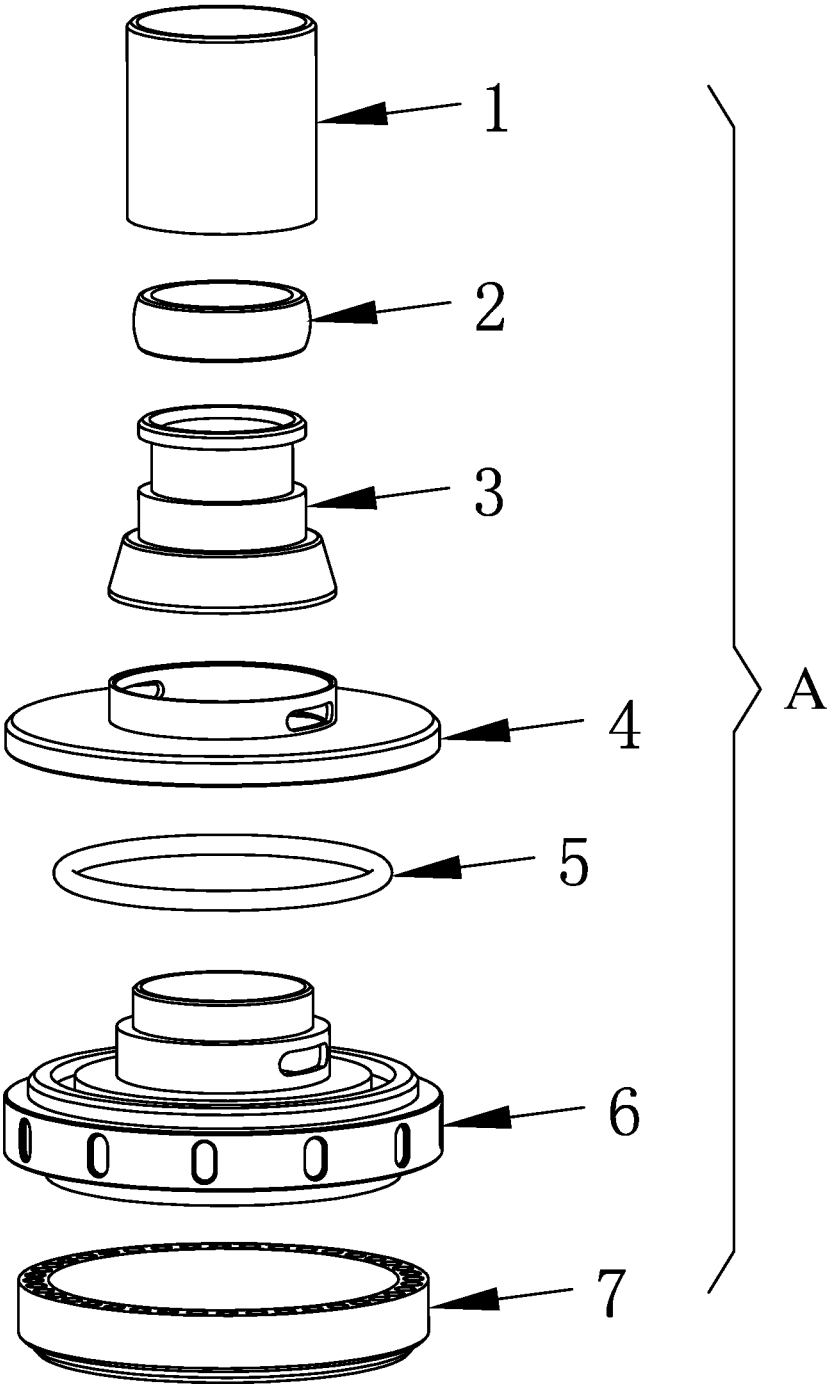
FIG. 2 is an exploded view of an air regulation ring assembly of an electronic cigarette in accordance with one embodiment of the invention.
Figure 3:
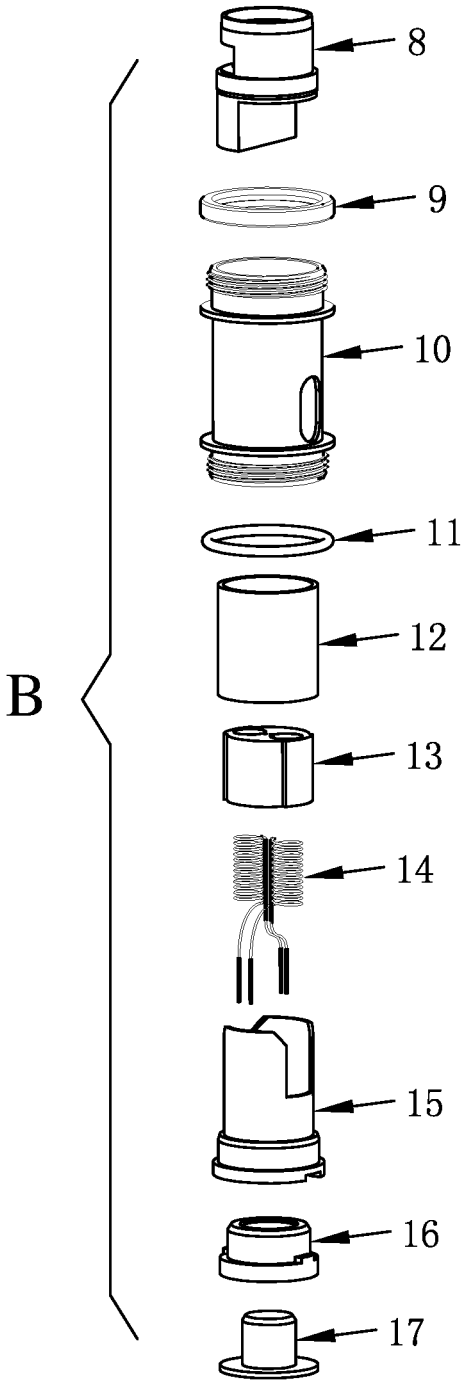
FIG. 3 is an exploded view of an atomizing core assembly of an electronic cigarette in accordance with one embodiment of the invention.
Figure 4:
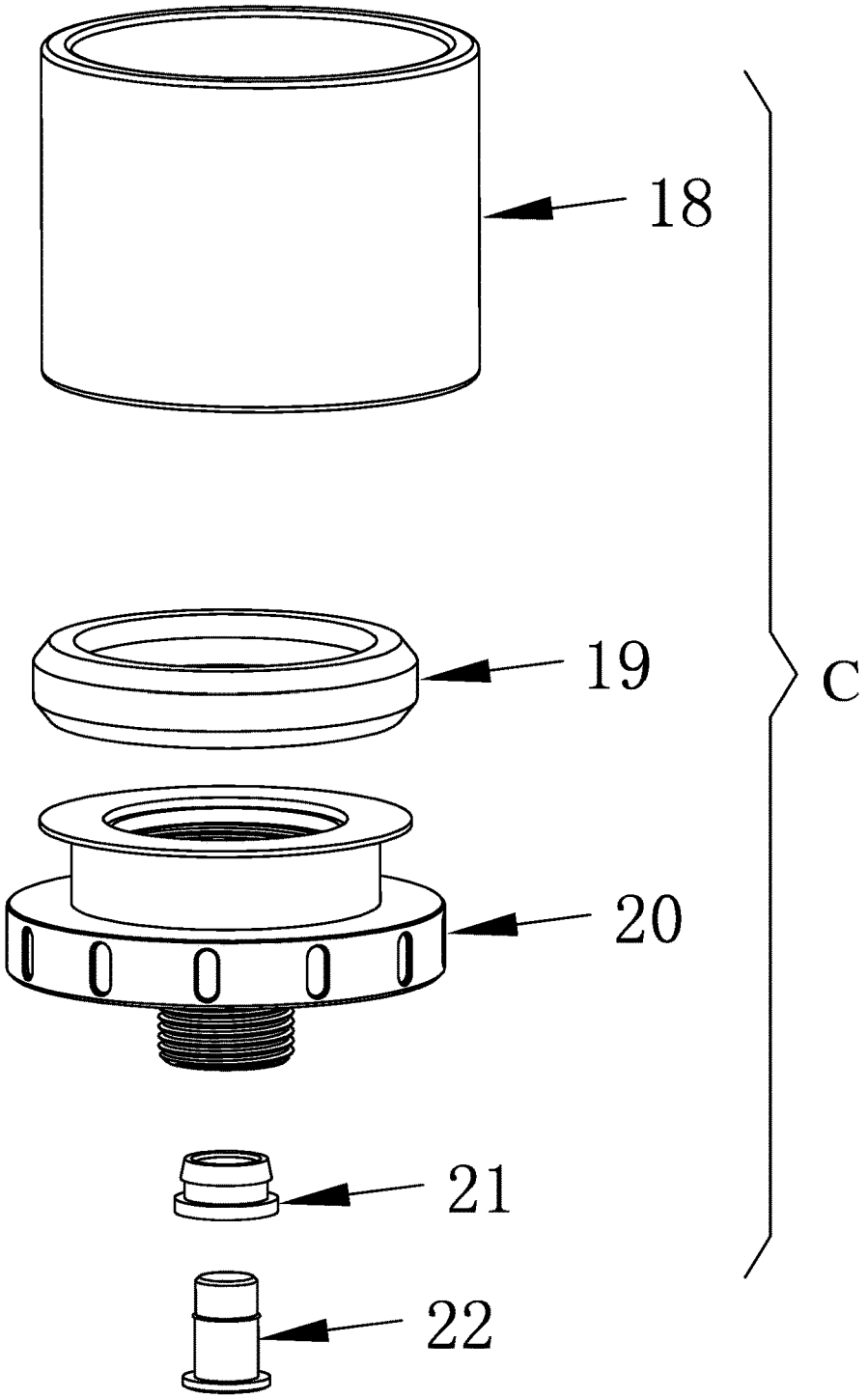
FIG. 4 is an exploded view of a base assembly of an electronic cigarette in accordance with one embodiment of the invention.
Figure 5:
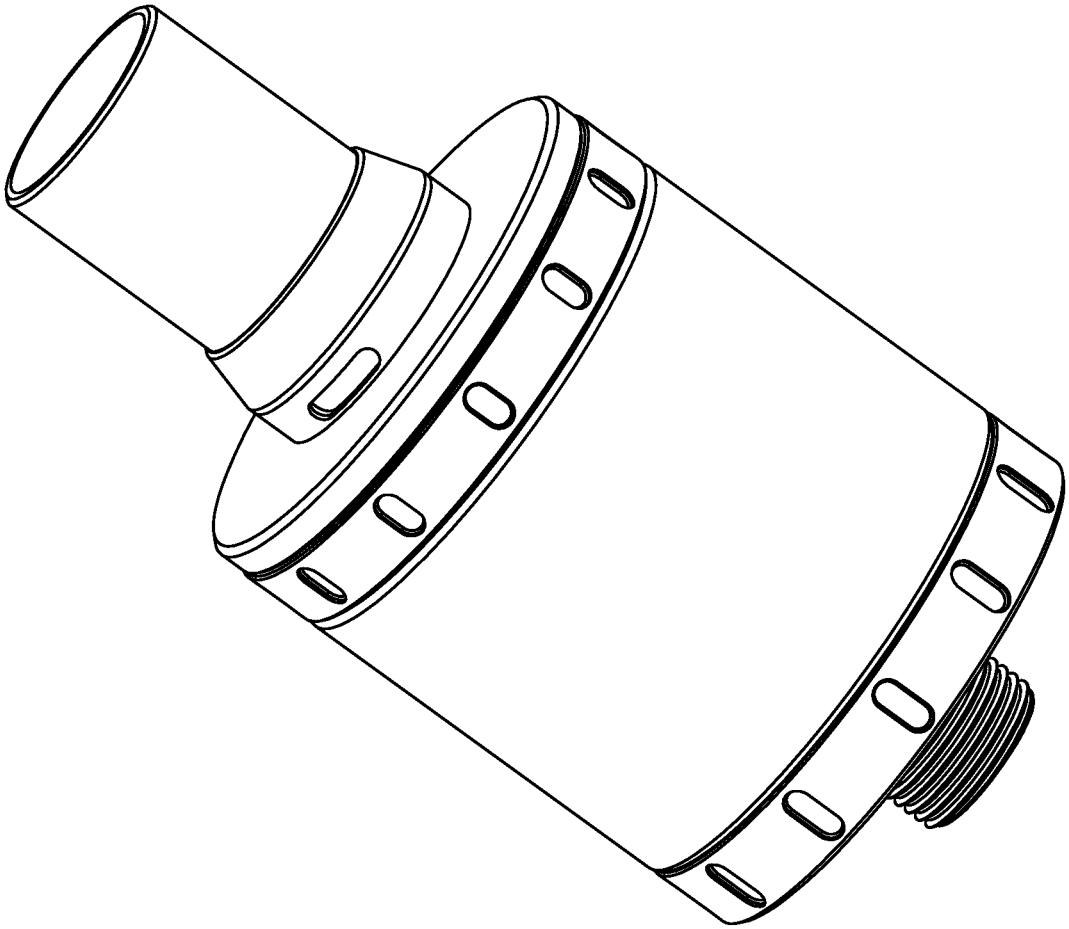
FIG. 5 is a stereogram of an electronic cigarette in accordance with one embodiment of the invention.
Figure 6:
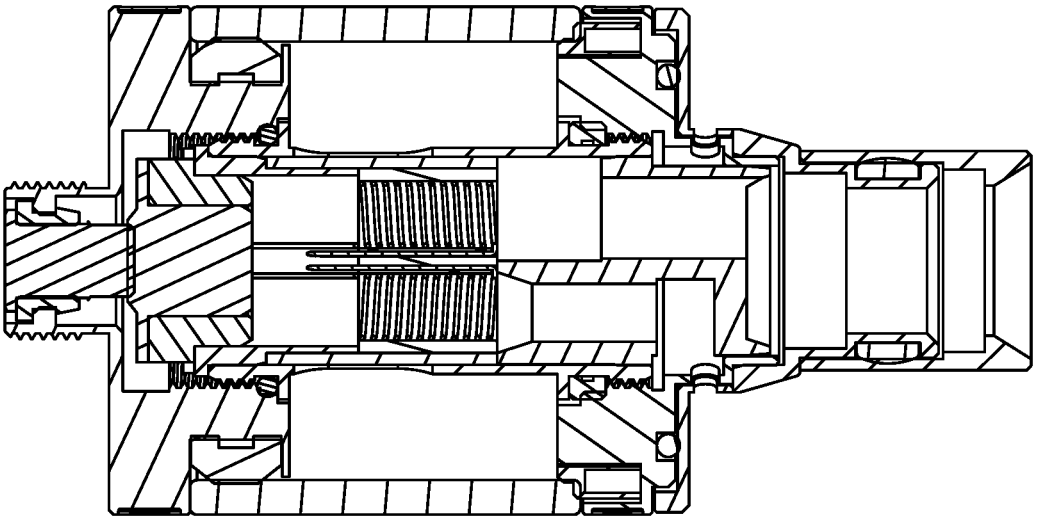
FIG. 6 is a cross-sectional view of an electronic cigarette in accordance with one embodiment of the invention.

As shown in FIGS. 1-6, an electronic cigarette comprises an air regulation ring assembly A, an atomizing core assembly, and a base assembly. The air regulation ring assembly comprises a mouthpiece 1, a first sealing ring 2, and a mouthpiece fixing base 3. The fixing base of the mouthpiece 3 is provided with a slot, and the first sealing ring 2 is disposed on the slot, so that the mouthpiece 1 is properly disposed in the fixing base of the mouthpiece 3, and resistance exists when the mouthpiece 1 is pulled out. A fixing base 6 of air regulation ring comprises an upper slot and a lower slot, and a second sealing ring 5 is secured to the upper slot on the fixing base 6 of air regulation ring. An air regulation ring 4 is fixedly connected to the fixing base 6 of the air regulation ring. Two sides of the air regulation ring 4 each are provided with a hole. Air is input from one hole, and is output from the other hole. The air fixing base 6 is rotated to regulate the air flow. The second sealing ring 5 provides resistance when the fixing base 6 is rotated, thus ensuring a proper rotation of the fixing base 6. The rubber silicon ring 7 is disposed in the lower slot on the fixing base 6. The rubber silicon ring is integrated with a glass tube 18 of the base assembly C and a fifth sealing ring 19 of the base assembly to seal the e-liquid.

Preferably, the atomizing core assembly B comprises a pair of heating wires 14. The heating wires are nickel-chromium material, and are sheathed in the second piece of cotton 13. The heating wires 14 are installed vertically in the fixing ring 15. The heating wires 14 comprise two feet. One foot is connected to the heating wire connector 17, and the other foot is connected to an inner wall of the fixing ring 15. When the heating wires 14 are electrified, the second piece of cotton 13 is adapted to absorb and store the e-liquid, and smoke is naturally produced. The first insulating ring 16 is hollow, and is mounted in a lower part of the fixing ring 15. The heating wire connector 17 is inserted in a central hole of the first insulating ring 16. The heating wire connector 17 is used as a positive electrode and is connected to an anodic foot of the heating wires 14, and a cathodic foot of the heating wires 14 is connected to the fixing ring 15. The first insulating ring 16 is adapted to isolate the positive electrode from the negative electrode, thus avoiding any short circuit. The first piece of cotton 12 is sleeved on the fixing ring 15. The fourth sealing ring 11 is mounted on the limit cover 10, and the limit cover is sleeved on the first piece of cotton 12. The limit cover 10 is fixedly connected to the fixing ring 15. Two sides of the limit cover 10 each are provided with an e-liquid inlet hole, and the e-liquid is allowed to enter from the e-liquid inlet hole of the limit cover 10, and passes through the first piece of cotton 12 and the second piece of cotton 13 to the heating wires which is electrified to produce large amount of smoke. The third sealing ring 9 is mounted on the limit cover 10, and the liquid barrier 8 is disposed on an upper part of the limit cover 10. the liquid barrier is fixedly connected to the limit cover. One side of the liquid barrier 8 is provided with an air inlet hole, and the other side of the liquid barrier is provided with an air outlet hole. Air is allowed to enter from the air inlet hole, pass through the heating wires 14 and the air outlet hole of the liquid barrier 8, and be discharged from the mouthpiece of the air regulation assembly A.

Preferably, the base assembly C comprises a copper thread ring 20, a second insulating ring 21, and a connector 22. The second insulating ring comprises a central hole. The second insulating ring is mounted on a lower part of the copper thread ring. The connector is adapted to conduct electricity for the positive electrode, and the connector is mounted on the lower part of the copper thread ring. The connector 22 is connected to the heating wire connector 17 of the atomizing core assembly B. The second insulating ring 21 is adapted to isolate the positive electrode from the negative electrode, thus avoiding short circuit. An upper part of the copper thread ring 20 is provided with a slot, and the fifth sealing ring 19 is secured to the slot on the upper part of the copper thread ring 20. The glass tube 18 is disposed on the copper thread ring, and the fifth sealing ring 19 is disposed lower than the glass tube 18. The glass tube 18 is adapted to store the e-liquid. The air regulation assembly A comprises the rubber silicon ring 7, and the rubber silicon ring is disposed higher than the glass tube. The rubber silicon ring is adapted to seal the e-liquid.

The air is input from the top of the electronic cigarette, and the air flow through which is also adjusted from the top. The heating wires are nickel-chromium material, and are vertically disposed. The air flow is input from a hole on the air regulation ring, passes through the heating wire on the left and the heating wire on the right, and is output from the mouthpiece, thus the air flow input and the air flow regulation are realized on the top of the electronic cigarette, effectively preventing the leakage of e-liquid. By twisting up the fixing base of the air regulation ring, and the e-liquid can be added in the cigarette.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

an air regulation ring assembly, the air regulation ring assembly comprising a mouthpiece having a fixing base and a rubber silicon ring, a first sealing ring, an air regulation ring having a fixing base, a second sealing ring;

an atomizing core assembly; the atomizing core assembly comprises a liquid barrier, a third sealing ring, a limit cover, a fourth sealing ring, a first piece of cotton, a second piece of cotton, a pair of heating wires having a fixing ring, a first insulating ring, and a heating wire connector; and a base assembly; the base assembly comprises a glass tube, a fifth sealing ring, a copper thread ring, a second insulating ring, and a connector;

wherein the fixing base of the mouthpiece is provided with a slot, and the first sealing ring is disposed on the slot; the mouthpiece is inserted to the fixing base of the mouthpiece; the fixing base comprises an upper slot and a lower slot, and the second sealing ring is secured to the upper slot on the fixing base of air regulation ring; the air regulation ring is fixedly connected to the fixing base of the air regulation ring; two sides of the air regulation ring each are provided with a hole; the rubber silicon ring is disposed in the lower slot on the fixing base; the rubber silicon ring is integrated with the glass tube and the fifth sealing ring of the base assembly to seal e-liquid;

the heating wires are sheathed in the second piece of cotton, and are installed vertically in the fixing ring; the heating wires comprise two feet; one foot is connected to the heating wire connector, and the other foot is connected to an inner wall of the fixing ring; the first insulating ring is hollow, and is mounted in a lower part of the fixing ring; the heating wire connector is inserted in a central hole of the first insulating ring; the heating wire connector is used as a positive electrode and is connected to an anodic foot of the heating wires, and a cathodic foot is connected to the fixing ring; the first piece of cotton is sleeved on the fixing ring; the fourth sealing ring is mounted on the limit cover, and the limit cover is sleeved on the first piece of cotton; the limit cover is fixedly connected to the fixing ring; two sides of the limit cover each are provided with an e-liquid inlet hole, and the e-liquid is allowed to enter from the e-liquid inlet hole of the limit cover, and passes through the first piece of cotton and the second piece of cotton to the heating wires; the third sealing ring is mounted on the limit cover, and the liquid barrier is disposed on an upper part of the limit cover; the liquid barrier is fixedly connected to the limit cover; one side of the liquid barrier is provided with an air inlet hole, and the other side of the liquid barrier is provided with an air outlet hole; air is allowed to enter from the air inlet hole, pass through the heating wires and the air outlet hole of the liquid barrier, and be discharged from the mouthpiece of the air regulation assembly; and the second insulating ring comprises a central hole; the second insulating ring is mounted on a lower part of the copper thread ring; the connector is mounted on the lower part of the copper thread ring; the connector is connected to the heating wire connector of the atomizing core assembly; an upper part of the copper thread ring is provided with a slot, and the fifth sealing ring is secured to the slot on the upper part of the copper thread ring; the glass tube is disposed on the copper thread ring, and the fifth sealing ring is disposed lower than the glass tube; the air regulation assembly comprises the rubber silicon ring of the mouthpiece.

* * * * *